US011208707B2

(12) United States Patent
Uehara et al.

(10) Patent No.: US 11,208,707 B2
(45) Date of Patent: Dec. 28, 2021

(54) NI-BASED ALLOY AND HEAT-RESISTANT SHEET MATERIAL OBTAINED USING SAME

(71) Applicant: HITACHI METALS, LTD., Tokyo (JP)

(72) Inventors: Toshihiro Uehara, Tokyo (JP); Shogo Momono, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 16/981,158

(22) PCT Filed: Mar. 20, 2019

(86) PCT No.: PCT/JP2019/011755
§ 371 (c)(1),
(2) Date: Sep. 15, 2020

(87) PCT Pub. No.: WO2019/182024
PCT Pub. Date: Sep. 26, 2019

(65) Prior Publication Data

US 2021/0115537 A1 Apr. 22, 2021

(30) Foreign Application Priority Data

Mar. 23, 2018 (JP) ..... JP2018-055992

(51) Int. Cl.
*C22C 19/05* (2006.01)
*C22F 1/10* (2006.01)

(52) U.S. Cl.
CPC ..... *C22C 19/056* (2013.01); *C22F 1/10* (2013.01)

(58) Field of Classification Search
CPC ..... C22F 1/10; C22C 19/056; C22C 19/055
See application file for complete search history.

(56) References Cited

U.S. PATENT DOCUMENTS

| | | | |
|---|---|---|---|
| 2008/0166258 | A1 | 7/2008 | Tanimoto et al. |
| 2018/0354019 | A1 | 12/2018 | Uehara et al. |

FOREIGN PATENT DOCUMENTS

| | | | |
|---|---|---|---|
| JP | 9-279315 | A | 10/1997 |
| JP | 2008-75171 | A | 4/2008 |
| JP | 2008-144202 | A | 6/2008 |
| JP | 2011-80598 | A | 4/2011 |
| JP | 2016-132824 | A | 7/2016 |
| WO | 2008/021635 | A2 | 2/2008 |
| WO | 2017/104755 | A1 | 6/2017 |

OTHER PUBLICATIONS

English language translation of International Search Report, PCT Application No. PCT/JP2019/011755, dated Jun. 18, 2019.

*Primary Examiner* — Jessee R Roe
(74) *Attorney, Agent, or Firm* — Myers Bigel, P.A.

(57) ABSTRACT

The present invention provides a Ni-based alloy that is hot-workable and exhibits an excellent high-temperature strength, and provides a heat-resistant plate material using the same. This Ni-based alloy is composed of, by mass, C: 0.002 to 0.10%, Si: less than 1.0%, Mn: up to 1.0%, P: up to 0.04% (including 0%), S: up to 0.01% (including 0%), Cr: 15.0 to 25.0%, Co: 0.1 to 18.0%, Mo: not less than 2.0% and less than 4.0%, Al: 3.0 to 5.0%, Ti: not less than 0.01% and less than 0.5%, Zr: 0.01 to 0.1%, B: 0.001 to 0.015%, Fe: up to 3.0%, Mg or Mg+0.6×Ca: 0.0005 to 0.01%, N: up to 0.01% (including 0%), O: up to 0.005% (including 0%), and the balance of Ni with inevitable impurities, S/Mg or S/(Mg+0.6×Ca) being up to 1.0, and a G value represented by the following formula (1) being 30 to 45.

$$G=7+0.11\mathrm{Cr}+8.23\mathrm{Al}+4.66\mathrm{Ti}-0.13(\mathrm{Ni}+\mathrm{Co}) \quad (1)$$

5 Claims, 3 Drawing Sheets

NI-BASED ALLOY AND HEAT-RESISTANT SHEET MATERIAL OBTAINED USING SAME

RELATED APPLICATIONS

This application is a 35 U.S.C. § 371 national stage application of PCT Application No. PCT/JP2019/011755, filed on Mar. 20, 2019, which claims priority from Japanese Patent Application No. 2018-055992, filed on Mar. 23, 2018, the contents of which are incorporated herein by reference in their entireties. The above-referenced PCT International Application was published in the Japanese language as International Publication No. WO 2019/182024 A1 on Sep. 26, 2019.

TECHNICAL FIELD

The present invention relates to a Ni-based alloy that is hot workable and exhibits an excellent high-temperature strength, and relates to a heat-resistant plate material using the same.

BACKGROUND ART

In an internal combustion engine such as an automobile engine, joining is carried out at various joinings by interposing a metal gasket in order to prevent leakage of high-temperature combustion gas and cooling water and to maintain airtightness. In recent years, the combustion temperature of the engine has tended to increase due to the improvement of fuel efficiency of automobiles, the tightening of emission control, etc. Furthermore, the number of engines equipped with a turbocharger or EGR that uses high-temperature exhaust gas is also increasing. Due to the higher combustion temperature of automobile engines, it is required to improve the heat resistance of engine parts. As a metal material used for exhaust engine valves, spark plugs, wheels for turbochargers, and the like, heat-resistant materials having higher high-temperature strength and higher oxidation resistance are being applied. Exhaust metal gaskets, metal springs, heat-resistant bolts, etc. used in the joint parts of engines including turbochargers, EGR, etc. are no exception, and high strength at high temperatures is required.

Conventionally, SUS 301 austenitic stainless steel is often used for a metal gasket for a cylinder head of an automobile engine. However, as engine performance has increased, austenitic stainless steel for metal gaskets containing a large amount of N, which has further improved strength, high temperature strength, oxidation resistance, etc., has been developed (Patent Document 1). In addition, a metal gasket made of a Fe—Ni—Cr alloy strengthened by a combination of cold rolling and precipitation hardening and a method for producing the same are disclosed (Patent Document 2).

REFERENCE DOCUMENT LIST

Patent Document

Patent Document 1: JP H9-279315 A
Patent Document 2: JP 2011-80598 A

SUMMARY OF THE INVENTION

Problem to be Solved by the Invention

The stainless steel disclosed in Patent Document 1 is an austenitic stainless steel that has improved heat resistance strength by adding a large amount of N. However, there is a limit to improving the high temperature strength by adding N for use in a metal gasket of an exhaust system exposed to higher temperatures. Furthermore, Patent Document 2 discloses alloys and manufacturing methods for various Fe—Ni—Cr alloy metal gaskets. In particular, the precipitation hardenable Fe—Ni—Cr alloy has an improved high temperature strength because the γ' (gamma prime) phase and/or the γ" (gamma double prime) phase, which are intermetallic compounds composed of Ni, Al, Ti, and Nb, are finely age precipitated. However, even the precipitation hardening Fe—Ni—Cr alloy containing Ni, Al, Ti, Nb, etc. disclosed in Patent Document 2 has a problem such as not being able to cope with the recent increase in engine temperature, a heat-resistant alloy that can withstand higher temperatures has been desired.

An object of the present invention is to provide a high-strength Ni-based alloy mainly suitable for an exhaust system joint exposed to a high temperature such as an automobile engine, which is capable of facilitating processing such as hot working and cold working and has excellent high-temperature strength, and a heat-resistant plate material using the same.

Means for Solving the Problem

In order to solve such problems, the present inventors evaluated the thermal settling resistance of Alloy 718, which is generally known to exhibit high strength and found that the deformation due to the thermal settling was small at 700° C., but the deformation due to the thermal settling was large at 800° C. On the other hand, the Waspaloy alloy is known as a precipitation-strengthened Ni-based alloy having higher high-temperature strength than Alloy 718. However, the Waspaloy alloy has a problem in that hot working is difficult because the solid solution temperature of the γ' phase, which is a precipitation strengthening phase, is high.

Therefore, earnest research was conducted on a precipitation-strengthened Ni-based superalloy which has higher high-temperature strength than the Alloy 718 and improved hot workability compared to the Waspaloy alloy. As a result, in a precipitation-strengthened Ni-based alloy having a high strength at high temperature such as a Waspaloy alloy, it was found that in order to improve hot workability, optimization of chemical compositions for lowering the solvus temperature of the γ' phase which is the precipitation-strengthened phase is effective, and in order to obtain high high-temperature strength, optimization of chemical compositions for increasing the amount of γ' phase is effective. Thus, the present inventors have found alloy compositions that can achieve both good hot workability and high high-temperature strength.

Furthermore, it is known that in order to lower the solvus temperature of the γ' phase and simultaneously increase the amount of precipitation, it is preferable to generate the γ' phase consisting of only Ni and Al without adding Ti and Nb. However, since MC type carbides are not generated unless Ti and Nb are added at all, $M_6C$ type carbides are easily generated and segregation easily occurs. Thus, the present inventors have found that addition of a small amount of Ti is effective for suppressing segregation. Based on these new findings, the inventors have found the optimum chemical composition balance for a Ni-based alloy that can be easily manufactured by hot working and cold working and has excellent high-temperature strength, and came to this invention.

That is, the present invention is directed to a Ni-based alloy consisting of, by mass, C: 0.002 to 0.10%, Si: less than 1.0%, Mn: up to 1.0%, P: up to 0.04% (including 0%), S: up to 0.01% (including 0%), Cr: 15.0 to 25.0%, Co: 0.1 to 18.0%, Mo: not less than 2.0% and less than 4.0%, Al: 3.0 to 5.0%, Ti: not less than 0.01% and less than 0.5%, Zr: 0.01 to 0.1%, B: 0.001 to 0.015%, Fe: up to 3.0%, Mg or Mg+0.6×Ca: 0.0005 to 0.01%, N: up to 0.01% (including 0%), O: up to 0.005% (including 0%), and the balance of Ni with inevitable impurities, wherein S/Mg or S/(Mg+0.6×Ca) is up to 1.0, and wherein a G value represented by the following formula (1) is 30 to 45.

$$G=7+0.11Cr+8.23Al+4.66Ti-0.13(Ni+Co) \quad (1)$$

Preferably, the high-strength Ni-based alloy consists of, by mass, C: 0.005 to 0.05%, Si: up to 0.5%, Mn: up to 0.5%, P: up to 0.03% (including 0%), S: up to 0.007% (including 0%), Cr: 16.0 to 23.0%, Co: not less than 4.0% and less than 15.0%, Mo: not less than 3.0% and less than 4.0%, Al: 3.0 to 5.0%, Ti: 0.05% to 0.3%, Zr: 0.02 to 0.08%, B: 0.002 to 0.010%, Fe: up to 3.0%, Mg or Mg+0.6×Ca: 0.0005 to 0.01%, N: up to 0.01% (including 0%), O: up to 0.005% (including 0%), and the balance of Ni with inevitable impurities, and S/Mg or S/(Mg+0.6×Ca) is up to 1.0.

Furthermore, in the present invention, the solvus temperature of the γ' phase is preferably 900 to 1000° C.

The present invention is also directed to a heat-resistant plate material made of the Ni-based alloy.

Effects of the Invention

According to the present invention, metal gaskets, springs for high temperature, heat-resistant bolts, seal rings, etc., which are used for joining parts exposed to high temperatures such as an exhaust system of an automobile engine, have higher reliability because good hot workability to a material to be worked, good cold workability for the shape of parts, high strength during use at high temperatures, good thermal settling resistance, and the like can be achieved.

MODE FOR CARRYING OUT THE INVENTION

Figure 1:
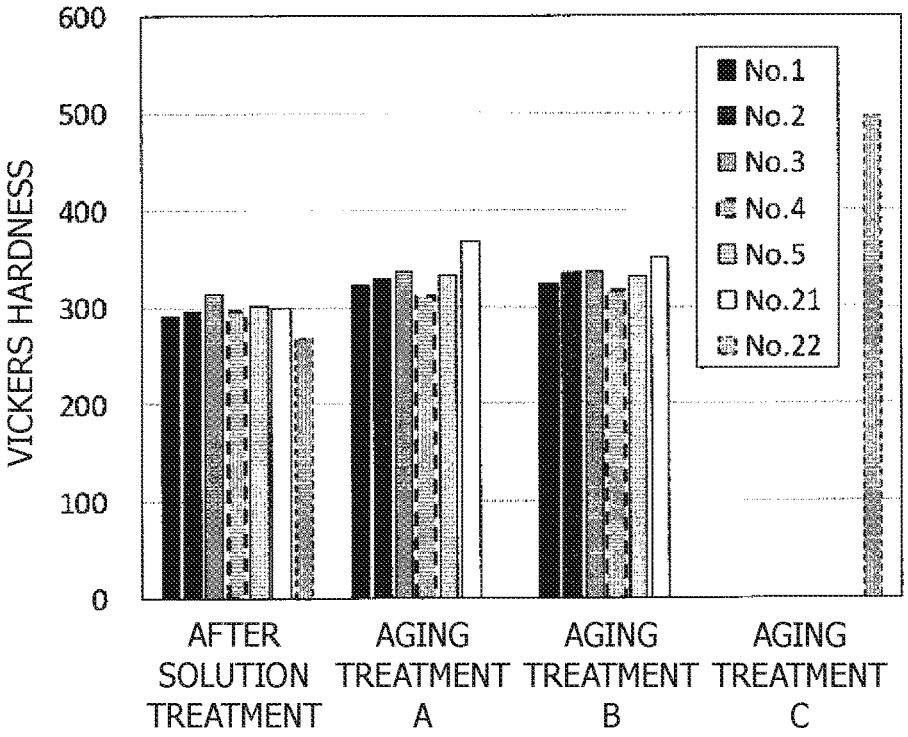
FIG. 1 is a diagram showing the comparison of Vickers hardness after solution treatment at 1040° C. and after aging treatment.

First, each element specified in the present invention and its content will be described. In addition, the content is described as mass % unless otherwise specified.

C: 0.002 to 0.10%

C not only improves the strength and ductility at room temperature and high temperatures in a well-balanced manner by forming MC type carbides with Ti and making the grains finer, but also forms a compound with S to produce the effect of enhancing the grain boundary strength. Thus, it is necessary to add a small amount. However, if it is less than 0.002%, the amount of MC-type carbides formed is reduced and a sufficient effect cannot be obtained, whereas if it exceeds 0.10%, coarse MC-type carbides are produced, reducing ductility, and decreasing the amount of Ti required for age hardening during use. Therefore, C was set at 0.002 to 0.10%. Preferably, the lower limit of C is 0.005% and the upper limit is 0.05%. Furthermore, in order to reliably obtain the effect of the C addition mentioned above, it is preferable that the lower limit of C be 0.01% and the upper limit of C be 0.04%.

Si: Less Than 1.0%, Mn: Up to 1.0%

Si and Mn are added as deoxidizing elements, but excessive addition may reduce the high temperature strength, so Si is limited to less than 1.0% and Mn is limited to up to 1.0%. More preferably, Si is up to 0.5% and Mn is up to 0.5%.

P: Up to 0.04% (Including 0%), S: Up to 0.01% (Including 0%)

P and S are impurity elements and are preferably contained in small amounts, and may each be 0%. Although P and S are not actively added, they may be mixed in from raw materials and the like. In the case of mixing, if P is up to 0.04% and S is up to 0.01%, it does not adversely affect the properties of the Ni-based alloy and the heat-resistant plate material of the present invention. Thus, P was set at up to 0.04% and S was set at up to 0.01%. P is preferably up to 0.03%, more preferably up to 0.01%. S is preferably up to 0.007%, more preferably up to 0.005%.

Cr: 15.0 to 25.0%

Cr is an element necessary for maintaining the oxidation resistance of the Ni-based alloy. If Cr is less than 15.0%, the oxidation resistance required for the Ni-based alloy cannot be obtained. On the other hand, if Cr exceeds 25.0%, the austenite phase of the matrix becomes unstable, and a harmful embrittlement phase such as σ (sigma) phase is generated during long-term use to reduce the strength and ductility of the Ni-based alloy. From this, Cr was set at 15.0 to 25.0%. The lower limit of Cr is preferably 16.0%, and the upper limit of Cr is preferably 23.0%.

Co: 0.1 to 18.0%

Co is an effective element that not only dissolves in the austenite phase to enhance strength by solid-solution strengthening, but also helps a large amount of Mo, Al, Ti, etc. to dissolve, indirectly promoting solid-solution strengthening and age hardening to improve strength. If the Co content is less than 0.1%, the effect tends to be insufficient, whereas if it exceeds 18.0%, work hardening increases, and thus, cold formability is likely to decrease, and also, an embrittlement phase is easily generated during use at high temperatures. Therefore, Co was set at 0.1 to 18.0%. It is preferably at least 4.0%, preferably up to 17.0%, more preferably less than 15.0%, and further more preferably up to 14.0%.

Mo: Not Less Than 2.0% and Less Than 4.0%

Mo is an element effective in increasing the room temperature and high temperature strength due to solid solution strengthening by dissolving in the austenite phase. It is a necessary and important element because it has an effect of suppressing deformation at high temperature by interaction with dislocations during use at high temperature. If Mo is less than 2.0%, the effect of improving high temperature strength is small, whereas if it is 4.0% or more, an embrittlement phase such as of $M_6C$ type carbide or a Laves phase may be generated. Thus, Mo was set at not less than 2.0% and less than 4.0%. The preferable lower limit of Mo is 3.0%.

Al: 3.0 to 5.0%

Al is one of the constituent elements of the γ' phase, which is an intermetallic compound that age-precipitates with Ti during aging treatment or during use, and is an element necessary for increasing the high temperature strength during use. In the present invention, by controlling the amount of Ti to be low, the amount of Ti in the γ' phase is reduced, and the main constituent elements of the γ' phase are Ni and Al. Furthermore, by increasing the amount of Al, the amount of γ' that age-precipitates is increased, so the precipitation strengthening effect in the operating temperature range is increased and the strength is increased. Furthermore, by using Ni and Al as the main constituent elements of the γ' phase, the solvus temperature of the γ' phase is lowered, and the strength in the hot forging temperature range is lowered to improve the hot workability. If Al is less than 3.0%, sufficient strength in the operating temperature range cannot be obtained, whereas if more than 5.0% is added, the solvus temperature of γ' becomes high and hot workability deteriorates. Therefore, Al was set at 3.0% to 5.0%. The preferable lower limit of Al is 3.5%.

Ti: Not Less Than 0.01% and Less Than 0.5%

Ti is one of the constituent elements of the γ' phase, which is an intermetallic compound that age-precipitates with Al during aging treatment or during use, and it is an element that is effective in increasing the high temperature strength during use. However, on the other hand, if the amount of Ti in the γ' phase increases, the solvus temperature of the γ' phase increases, and the γ' phase does not dissolve even in the hot working temperature range, resulting in a significant decrease in hot workability. Therefore, when importance is attached to hot workability, it is effective to suppress the amount of Ti to a low level and add only a small amount. Furthermore, Ti forms an MC type carbide together with C, and is effective in suppressing the growth of austenite grains and maintaining an appropriate grain size. Furthermore, since MC-type carbide containing Ti can dissolve S, it is effective in efficiently trapping S which is likely to segregate in the austenite grain boundaries, improving cleanliness, and increasing high temperature strength. If Ti is less than 0.01%, a sufficient effect cannot be obtained. On the other hand, if it is 0.5% or more, the solvus temperature of the γ' phase is too high and the hot workability deteriorates. Therefore, Ti was set at not less than 0.01% and less than 0.5%. The preferable lower limit of Ti is 0.05%, and the preferable upper limit of Ti is 0.3%.

Zr: 0.01 to 0.1%

Zr must be added to strengthen the grain boundaries. Since Zr has a significantly larger atomic size than Ni, which is an atom constituting the matrix, it has the effect of segregating at the grain boundaries and suppressing the grain boundary slip at high temperatures. In particular, it has the effect of significantly reducing the notch rupture sensitivity. Therefore, the effect of improving creep rupture strength and creep rupture ductility can be obtained, but if an excessive amount is added, the oxidation resistance deteriorates, whereas if it is less than 0.01%, the amount of segregation at the grain boundary is small, so that sufficient effect cannot be obtained. Thus, Zr was set at 0.01 to 0.1%. A preferable lower limit is 0.02%, and a preferable upper limit is 0.08%.

B: 0.001 to 0.015%

B is an element effective in increasing the strength and ductility at high temperatures due to the grain boundary strengthening action when added in a small amount. However, if it is less than 0.001%, the amount of segregation to the grain boundaries is small and the effect is not sufficient. On the other hand, if it exceeds 0.015%, the initial melting temperature during heating is lowered and the hot workability is lowered. Therefore, B was set at 0.001 to 0.015%. A preferable lower limit is 0.002%, and a preferable upper limit is 0.010%.

Fe: up to 3.0%

Fe has the effect of improving the hot workability and cold workability of the alloy.

However, if Fe exceeds 3.0%, the high temperature strength decreases and the oxidation resistance deteriorates, so Fe is limited to up to 3.0%. It is preferably up to 2.0%. In order to surely obtain the effect of Fe, the lower limit of Fe is preferably set at 0.3%.

Mg: 0.0005 to 0.01%

Mg not only has the effect of reducing oxygen as a deoxidizing agent, but it is added to improve the hot workability by fixing S by binding with S segregated at the grain boundaries. If Mg is less than 0.0005%, the effect of fixing S is not sufficient, while if it exceeds 0.01%, oxides and sulfides are increased to reduce the cleanliness, and a compound with Ni having a low melting point is increased to reduce the hot workability. Thus, Mg is limited to 0.0005 to 0.01%. The preferable lower limit of Mg is 0.001%, and the preferable upper limit of Mg is 0.007%. A more preferable upper limit of Mg is 0.005%. Note that part or all of Mg may be replaced with Ca, and in that case, (Mg+0.6×Ca) may be limited to the range of Mg alone.

S/Mg: up to 1.0

Since the purpose of adding Mg is to improve the hot workability by fixing S that segregates at the grain boundaries, the amount of addition is specified according to the amount of S. In order to suppress the harmful effect of S on the hot workability, it is effective to limit the value of S/Mg to up to 1.0. When part or all of Mg is replaced with Ca, it is preferable to limit S/(Mg+0.6×Ca) to up to 1.0. Relationship between S/Mg and S/(Mg+0.6×Ca) is preferably up to 0.5.

N: Up to 0.01% (Including 0%), O: Up to 0.005% (Including 0%)

O and N combine with Al, Ti, Zr, B, Mg, etc. to form oxide or nitride inclusions to lower the cleanliness and lower the hot workability and cold workability. In addition to reducing the amount of Al and Ti forming the γ' phase, it may hinder the strength increase due to precipitation strengthening during use. Thus, it is preferable to keep it as low as possible and it may be 0%. Preferably, N is up to 0.01% and O is up to 0.005%, and more preferably O is up to 0.004% and N is up to 0.005%.

Balance of Ni with Inevitable Impurities

The balance Ni is an austenite forming element. Since the austenite phase is densely packed with atoms, the diffusion of atoms is slow even at high temperature and the high temperature strength is higher than that of the ferrite phase. Furthermore, the austenite matrix has a large solid solution limit of alloying elements, and is advantageous for precipitation of the γ' phase, which is a key to precipitation strengthening, and strengthening of the austenite matrix itself by solid solution strengthening. Ni is also a main constituent element of the γ' phase, which is a precipitation strengthening phase, and is an essential element. Since the most effective element that constitutes the austenite matrix is Ni, the balance is Ni in the present invention. Of course, impurities that are unavoidably contained are included.

In addition to the unavoidable impurities, the balance can be allowed to include the elements listed below within the following ranges producing little substantial effect.

W≤0.2%, total of Nb, Ta and REM≤0.1%

Furthermore, Ag, Sn, Pb, As, and Bi are also impurity elements that segregate at the austenite grain boundaries and cause a decrease in high temperature strength, and Ag, Sn, Pb, As, and Bi are preferably limited to up to 0.01% in total.

G value: 30 to 45

What is needed to obtain high high-temperature strength is the γ' phase, which is a strengthening phase that age-precipitates, and the higher the amount of γ' phase, the higher the high temperature strength, whereas if the γ' phase is excessively increased, the solvus temperature of the γ' phase rises so as to also increase the strength at the hot working temperature, and the hot workability deteriorates. Therefore, in order to achieve both high high-temperature strength in the operating temperature range and good hot workability in the hot working temperature range, it is necessary to adjust amounts of the specific alloying element to the optimum balance. As a result of extensive research, the present inventors have selected Cr, Al, Ti, Ni, and Co as specific alloying elements to derive the relational expression, the following formula (1), and have determined an optimum range of G value, which is a value from the formula (1) related to the amount of γ'.

$$G=7+0.11Cr+8.23Al+4.66Ti-0.13(Ni+Co) \quad (1)$$

Here, each element symbol represents the value of mass % of the element. If the G value is less than 30, sufficient high temperature strength cannot be obtained, whereas if it is greater than 45, good hot workability cannot be obtained. Thus, the G value was set at 30 to 45.

Solvus Temperature of γ' phase: 900 to 1000° C.

The solvus temperature of the γ' phase greatly affects the hot workability. As the solvus temperature of the γ' phase is lower, the hot working temperature range in which the γ' phase, which hinders the hot workability, does not exist can be expanded to lower temperatures, which facilitates the hot working. When the solvus temperature of the γ' phase exceeds 1000° C., the temperature range in which hot working is possible narrows, which increases the number of hot working steps and decreases the productivity, or cracking occurs during hot working, which makes it difficult to process into a predetermined shape. However, if the temperature is lower than 900° C., the amount of γ' phase in the operating temperature range decreases and the heat resistant temperature decreases. Therefore, the solvus temperature of γ' phase is set at 900 to 1000° C. A preferable lower limit of the solvus temperature of the γ' phase is 920° C., and a preferable upper limit of the solvus temperature of the γ' phase is 980° C.

The inventive alloy can achieve both high-temperature strength in the operating temperature range and good hot workability in the hot working temperature range, thus if applied to a forged material that is hot worked by a press, hammer, ring mill, etc. (for example, gas turbine disk, gas turbine case, etc.), it is easy to manufacture, and high strength at high temperatures can be obtained. Furthermore, it is easy to manufacture a product having a highly processed shape and dimensions with a small cross-sectional area, such as plate materials (including coiled strips), rods and wires (including coiled wires) manufactured by hot rolling, cold rolling, cold drawing, etc. by utilizing good hot workability. Especially when applied to a heat-resistant plate material, the heat resistant temperature of the metal gasket and the spring for high temperature can be greatly increased.

In general, the heat-resistant plate material often has a thickness of up to 1 mm, but the thickness is not limited thereto. Furthermore, the heat-resistant plate material and the wire are often used as parts in solution-treated state or after being subjected to solution treatment followed by aging treatment. However, for parts that need to be molded into highly precise shape, or for parts that require initial hardness and tensile strength, they may be used after being subjected to solution treatment followed by mild cold working, or further aging treatment. Thus, it is permissible to appropriately select the conditions for heat treatment and cold working to the extent that they do not significantly degrade the required properties.

EXAMPLES

Example 1

A 10 kg ingot was produced by vacuum induction melting. The chemical compositions of the alloys No. 1 to 5, which were produced within the composition range specified in the present invention, and the comparative alloys No. 21 and 22 are shown in Table 1 and Table 2. In addition, as a melting method, a general melting method for superalloys can be applied, including but not limited to, for example, vacuum induction melting only, double melting of vacuum induction melting followed by vacuum arc remelting, double melting of vacuum induction melting followed by electroslag remelting, triple melting of vacuum induction melting followed by electroslag remelting and vacuum arc remelting. The ingots shown in Table 1 and Table 2 were subjected to homogenization treatment at 1180° C. for 20 hours and then hot forged (hot plastic working) to produce bar materials having a cross section of 20 mm×45 mm. The alloys having the composition range specified in the present invention showed no cracking during hot forging, and had good hot workability. On the other hand, cracking was found at the corners of the comparative alloy No. 21. In addition, a round bar tensile test piece having parallel part diameter of 8 mm and parallel part length of 24 mm was taken from the bar material and subjected to a tensile test at a strain rate of 10/sec at various high temperatures. The temperature range for 60% or more reduction of area in fracture was measured and the hot workability was evaluated.

TABLE 1

(mass %)

| No. | C | Si | Mn | P | S | Cr | Mo | Co | Al | Ti | Nb | Fe | Zr | B | Mg | N | O | Balance |
|---|---|---|---|---|---|---|---|---|---|---|---|---|---|---|---|---|---|---|
| 1 | 0.03 | 0.01 | 0.01 | 0.001 | 0.0006 | 18.00 | 3.89 | 12.61 | 3.89 | 0.21 | — | 0.92 | 0.06 | 0.0045 | 0.0012 | 0.0005 | 0.0003 | Ni with inevitable impurities |

TABLE 1-continued

| No. | C | Si | Mn | P | S | Cr | Mo | Co | Al | Ti | Nb | Fe | Zr | B | Mg | N | O | (mass %) Balance |
|---|---|---|---|---|---|---|---|---|---|---|---|---|---|---|---|---|---|---|
| 2 | 0.03 | 0.01 | 0.01 | 0.001 | 0.0006 | 17.43 | 3.85 | 12.39 | 4.18 | 0.20 | — | 0.93 | 0.07 | 0.0048 | 0.0018 | 0.0006 | 0.0004 | Same as above |
| 3 | 0.03 | 0.01 | 0.01 | 0.001 | 0.0005 | 16.71 | 3.75 | 11.86 | 4.45 | 0.20 | — | 0.93 | 0.07 | 0.0046 | 0.0018 | 0.0005 | 0.0003 | Same as above |
| 4 | 0.03 | 0.01 | 0.01 | 0.001 | 0.0005 | 17.40 | 3.85 | 16.89 | 4.17 | 0.20 | — | 0.92 | 0.06 | 0.0050 | 0.0017 | 0.0006 | 0.0003 | Same as above |
| 5 | 0.03 | 0.01 | 0.01 | 0.001 | 0.0006 | 17.64 | 3.85 | 6.08 | 4.18 | 0.21 | — | 0.93 | 0.06 | 0.0041 | 0.0014 | 0.0006 | 0.0006 | Same as above |
| 21 | 0.03 | 0.01 | 0.01 | 0.001 | 0.0005 | 19.25 | 4.16 | 13.64 | 1.37 | 3.03 | — | 0.98 | 0.05 | 0.0049 | 0.0017 | 0.0006 | 0.0016 | Same as above |
| 22 | 0.02 | 0.10 | 0.06 | 0.007 | 0.0006 | 18.40 | 3.00 | 0.09 | 0.58 | 0.95 | 5.16 | 18.98 | — | 0.0048 | 0.0005 | 0.0042 | 0.0004 | Same as above |

TABLE 2

| No. | S/Mg | G value | Note |
|---|---|---|---|
| 1 | 0.50 | 32.5 | Invention alloy |
| 2 | 0.33 | 34.7 | Invention alloy |
| 3 | 0.28 | 36.8 | Invention alloy |
| 4 | 0.29 | 34.6 | Invention alloy |
| 5 | 0.43 | 34.8 | Invention alloy |
| 21 | 0.29 | 25.3 | Comparative alloy |
| 22 | 1.20 | 11.4 | Comparative alloy |

A plate material having a thickness of 2 mm was cut out from the forged materials of the invention alloys No. 1 to 5, and the solution treatment was at 1040° C. and cold rolling was repeated, and finally cold rolling was performed at a rolling reduction of 50% to produce a plate material having a thickness of 0.2 mm. A plate material having a thickness of 2 mm was also cut out from the forged materials of the comparative alloys No. 21 and 22. The solution treatment at 1080° C. and cold rolling were repeated for the comparative alloy No. 21, and the solution treatment at 980° C. and cold rolling were repeated for the comparative alloy No. 22, and finally cold rolling was performed at a rolling reduction of 50% to produce a plate material having a thickness of 0.2 mm in each case.

The plate materials of the invention alloy and the comparative alloy having a thickness of 0.2 mm were subjected to a solution treatment held at 1040° C. for 5 minutes, followed by rapid cooling. The plate material of the comparative alloy No. 21 was subjected to a solution treatment held at 1080° C. for 5 minutes, followed by rapid cooling. Furthermore, the plate materials of the invention alloy and the comparative alloy No. 21 were subjected to solution treatment, followed by short-term aging treatment at 840° C. for 4 hours (aging treatment A) and short-term aging treatment at 760° C. for 4 hours (aging treatment B), followed by air cooling. On the other hand, the plate material of the comparative alloy No. 22 was subjected to a solution treatment by holding it at 980° C. for 1 hour and then rapidly cooling.

After the solution treatment, it was subjected to a long aging treatment (aging treatment C) holding at 720° C. for 8 hours, cooling to 620° C. over 2 hours, holding at 620° C. for 8 hours, and then air cooling. Vickers hardness measurement and thermal settling test were performed on the solution treated material and the aging treated material.

In the thermal settling test, a plate-like test piece having a width of 10 mm and a length of 100 mm was heated at 700° C. and 800° C. for 4 hours in a state in which the central portion in the length direction was bent by 5 mm with respect to a length of 80 mm. The amount of flexural deformation after cooling was measured, and the thermal settling displacement was calculated from the difference in the amount of deflection before and after heating, and the thermal settling resistance was evaluated according to the size.

Table 3 shows the solvus temperature of the γ' phase obtained by the thermodynamic phase diagram calculation and the temperature range in which the reduction of area in fracture in the high temperature tensile test was 60% or more. As shown in Table 3, it can be seen that all the invention alloys have a solvus temperature of the γ' phase between 900 and 1000° C., and have a wide temperature range of 300° C. or more in which the reduction of area in fracture in the high temperature tensile test is 60% or more. On the other hand, in the comparative alloy No. 21, it can be seen that the solvus temperature of the γ' phase exceeds 1000° C., and the temperature range in which the reduction of area in fracture in the high temperature tensile test is 60% or more is only 220° C. and is narrow. This shows that the invention alloys have a sufficiently wide hot working temperature range and good hot workability.

TABLE 3

| No. | γ' phase solvus temperature (° C.) | Temperature range for 60% or more reduction of area in rupture (° C.) | Note |
|---|---|---|---|
| 1 | 930 | >370 | Invention alloy |
| 2 | 951 | >370 | Invention alloy |
| 3 | 970 | 340 | Invention alloy |
| 4 | 944 | 370 | Invention alloy |
| 5 | 960 | >370 | Invention alloy |
| 21 | 1031 | 220 | Comparative alloy |

FIG. 1 shows the Vickers hardness at room temperature after solution treatment and aging treatment. The hardness results for "after solution treatment" in FIG. 1 are, from left to right, No. 1 to 5, No. 21 and 22. The hardness results of "aging treatment A" and "aging treatment B" are, from left to right, Nos. 1 to 5, and 21. The hardness of "aging treatment C" is No. 22.

The hardness of the inventive alloy after solution treatment is about 300 HV in Vickers hardness, and the hardness is slightly increased by aging treatment, but it is about 310 to 340 HV in Vickers hardness. The hardness after solution treatment is low enough to allow cold plastic working such as cold rolling. On the other hand, the comparative alloy No. 21 has a Vickers hardness of about 300 HV after the solution treatment, but it hardens by aging treatment to about 350 to 360 HV. In addition, the comparative alloy No. 22 has a low Vickers hardness of about 270 HV after the solution treatment, but it significantly hardens by the aging treatment to a hardness a little less than about 500 HV. The hardness of the inventive alloy at room temperature is slightly lower than that of the comparative alloy.

Figure 2:
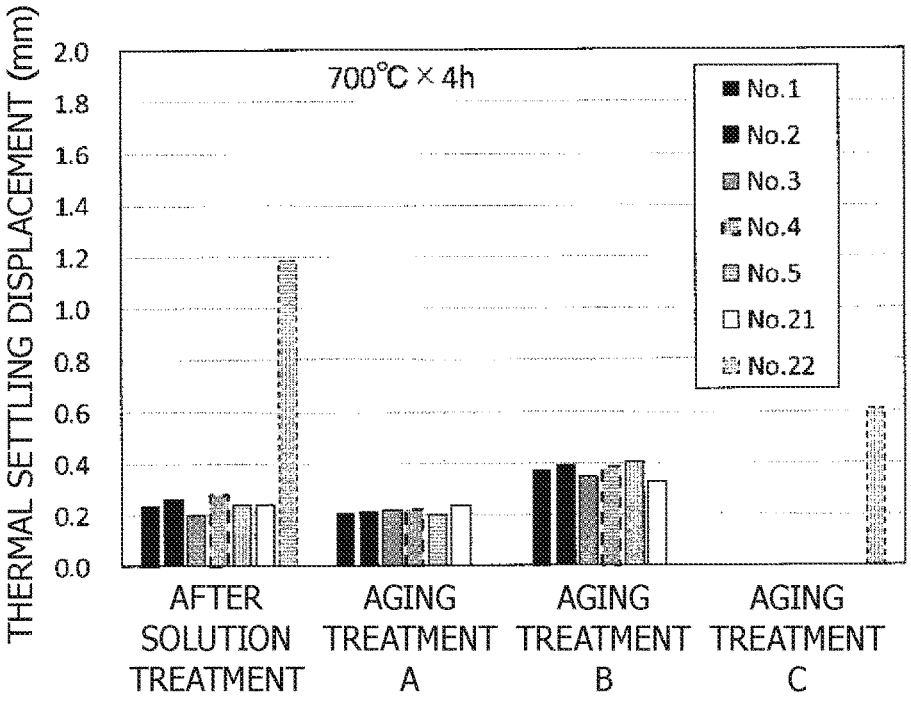
FIG. 2 is a diagram showing the comparison of thermal settling displacement after heating at 700° C. for 4 hours after solution treatment at 1040° C. and after aging treatment.
Figure 3:
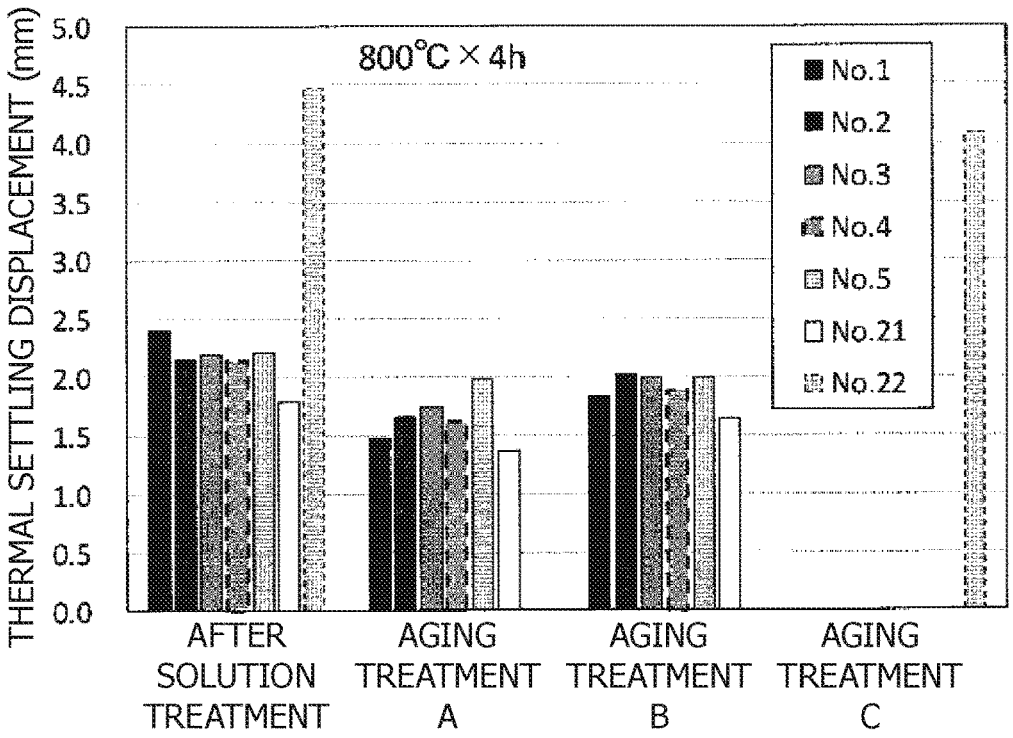
FIG. 3 is a diagram showing a comparison of thermal settling displacement after heating at 800° C. for 4 hours after solution treatment at 1040° C. and after aging treatment.

FIG. 2 and FIG. 3 show the thermal settling displacement after the solution treatment and the aging treatment. The results of the thermal settling displacement "after solution treatment" in FIG. 2 and FIG. 3 are, from left to right, Nos. 1 to 5, Nos. 21 and 22. The results of the thermal settling displacement of "aging treatment A" and "aging treatment B" are, from left to right, Nos. 1 to 5, and No. 21. The thermal settling displacement of "aging treatment C" is No. 22.

As shown in FIG. 2 and FIG. 3, compared with the comparative alloy No. 21, the invention alloys Nos. 1 to 5 have the same thermal settling displacement after both the solution treatment and the aging treatment, and the thermal settling resistance is good. However, the comparative alloy No. 21, as shown in Table 3, has a hot workability inferior to that of the inventive alloys, and when it is applied to relatively thin plate-shaped parts, there remains a problem in manufacturability. In addition, it can be seen that the comparative alloy No. 22 has a large thermal settling displacement after both the solution treatment and the aging treatment, and the thermal settling resistance is much worse than that of the invention alloys. As described above, it is understood that the invention alloy has both good manufacturability and good thermal settling resistance.

Furthermore, 0.2 mm-thick plate materials cold-rolled at a rolling reduction of 50% from the invention alloys Nos. 1 to 5 were treated by changing the solution treatment temperature to high temperatures. That is, the invention alloys Nos. 1 to 3 were subjected to solution treatment holding at 1125° C. for 5 minutes, followed by rapid cooling. The invention alloy No. 4 was subjected to solution treatment holding at 1100° C. for 5 minutes, followed by rapid cooling. The invention alloy No. 5 was subjected to solution treatment holding at 1150° C. for 5 minutes, followed by rapid cooling. Furthermore, after the solution treatment, a short-time aging treatment at 840° C. for 4 hours (aging treatment A) and a short-time aging treatment at 760° C. for 4 hours (aging treatment B) were performed, followed by air cooling.

Figure 4:
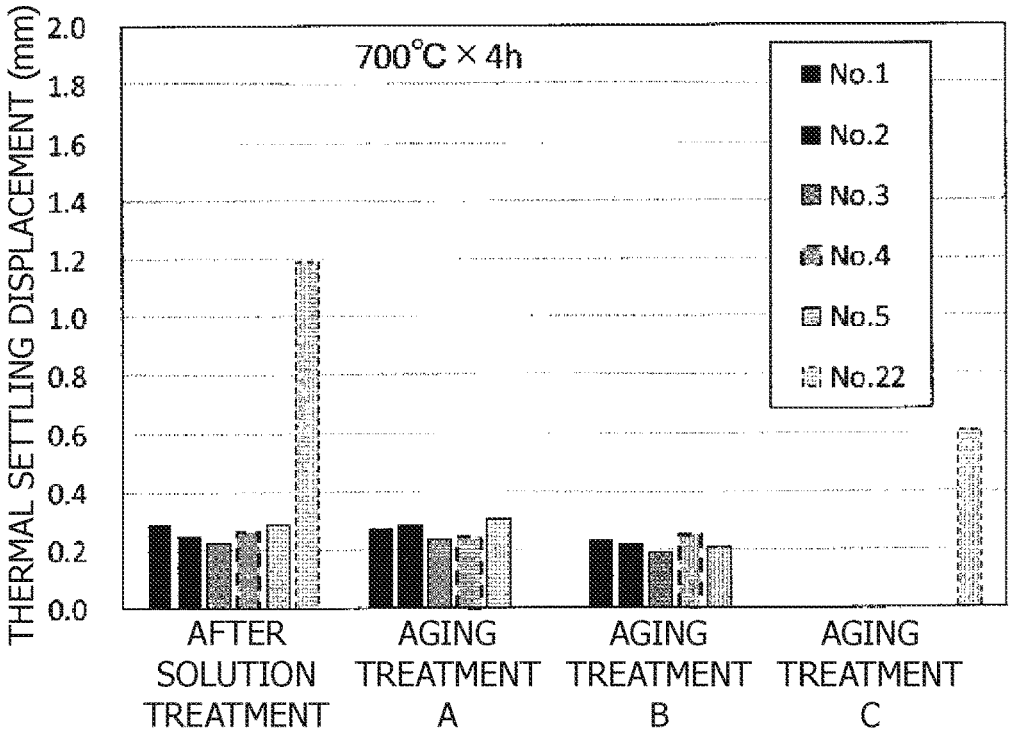
FIG. 4 is a diagram showing a comparison of thermal settling displacement after heating at 700° C. for 4 hours after high temperature solution treatment at 1100 to 1150° C. and after aging treatment.
Figure 5:
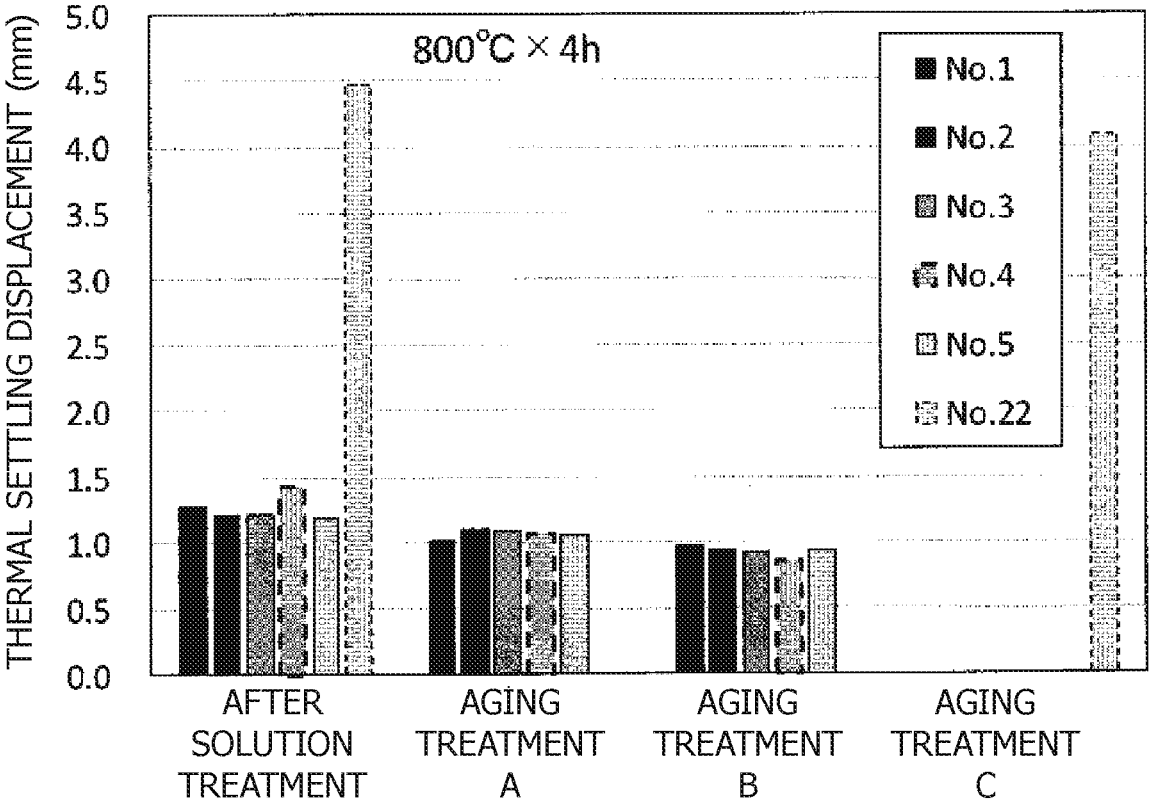
FIG. 5 is a diagram showing a comparison of thermal settling displacement after heating at 800° C. for 4 hours after high temperature solution treatment at 1100 to 1150° C. and after aging treatment.

The solution treated material and the aging treated material were subjected to a thermal settling test by a method of heating at 700° C. and 800° C. for 4 hours as described above. FIG. 4 and FIG. 5 show the thermal settling displacement after the solution treatment and the aging treatment.

The results of the thermal settling displacement "after solution treatment" in FIG. 4 and FIG. 5 are, from left to right, Nos. 1 to 5, and No. 22. The results of the thermal settling displacement of "aging treatment A" and "aging treatment B" are, from left to right, Nos. 1 to 5. The thermal settling displacement of "aging treatment C" is No. 22. As shown in FIG. 4 and FIG. 5, compared with the comparative alloy No. 22, the invention alloys Nos. 1 to 5 showed significantly small thermal settling displacement after both the solution treatment and the aging treatment, which is similar to the results shown in FIGS. 2 and 3. However, as shown in FIG. 4, in the thermal settling test at 700° C., the thermal settling displacement in the aging treatment B was less when the solution treatment was performed at higher temperatures than when the solution treatment was performed at 1040° C., and the thermal settling resistance was further improved. In addition, as shown in FIG. 5, in the thermal settling test at 800° C., the thermal settling displacement was more reduced when the solution treatment was performed at higher temperatures than when the solution treatment was performed at 1040° C. in any of the heat treatments "after solution treatment", "aging treatment A", and "aging treatment B", and the thermal settling resistance was further improved. This is thought to be due to the solution treatment at high temperatures promoting the solution process of the alloying elements that contribute to the precipitation strengthening and accelerates age hardening during thermal settling test, and the coarsening of austenite grains as a matrix prevents creep deformation.

From the results mentioned above, the Ni-based alloy of the present invention has suitable properties for, for example, metal gaskets and springs for high temperature.

Example 2

A 10 kg ingot was produced by vacuum induction melting. Table 4 and Table 5 show the chemical compositions of the alloy No. 6, which was produced within the composition range specified in the present invention, and the comparative alloy No. 23. Regarding the melting method, the general melting method for superalloys can be applied, including, but not limited to, for example, vacuum induction melting only, double melting of vacuum induction melting followed by vacuum arc remelting, double melting of vacuum induction melting followed by electroslag remelting, triple melting of vacuum induction melting followed by electroslag remelting and vacuum arc remelting. The ingots shown in Table 3 and Table 4 were subjected to homogenization treatment at 1180° C. for 20 hours and then hot forged (hot plastic working) to produce bar materials having a cross section of 20 mm×45 mm.

TABLE 4

(mass %)

| No. | C | Si | Mn | P | S | Cr | Mo | Co | Al | Ti | Nb | Fe | Zr | B | Mg | N | O | Balance |
|---|---|---|---|---|---|---|---|---|---|---|---|---|---|---|---|---|---|---|
| 6 | 0.03 | 0.02 | 0.01 | 0.002 | 0.0004 | 17.27 | 3.8 | 6.06 | 4.21 | 0.21 | — | 1.27 | 0.058 | 0.004 | 0.0042 | 0.0004 | 0.0007 | Ni with inevitable impurities |
| 23 | 0.03 | 0.02 | 0.01 | 0.002 | 0.0006 | 19.47 | 4.29 | 13.45 | 1.45 | 3.07 | — | 1.02 | 0.051 | 0.0052 | 0.0041 | 0.0006 | 0.0027 | Same as above |

TABLE 5

| No. | S/Mg | G value | Note |
|---|---|---|---|
| 6 | 0.50 | 32.5 | Invention alloy |
| 23 | 0.33 | 34.7 | Comparative alloy |

The forged bar materials were subjected to solution treatment of holding at 1020° C. for 4 hours, followed by air cooling. Furthermore, the bar materials were subjected to aging treatment of holding at 843° C. for 4 hours, followed by air cooling, and then holding at 760° C. for 16 hours, followed by air cooling. A round bar tensile test piece having a parallel part diameter of 6.35 mm and a gauge length of 25.4 mm was taken from the bar material after the aging treatment, and a tensile test was performed at room temperature. Similarly, a round bar tensile test piece having a parallel part diameter of 6.35 mm and a gauge length of 25.4 mm was taken from the bar material after the aging treatment, and subjected to a creep test with tensile stress of 276 MPa at 816° C. to determine the rupture time. In addition, a cylindrical test piece having a diameter of 10 mm and a length of 20 mm was taken from the bar material after the aging treatment, and then subjected to an oxidation test under the condition of holding in air at 800° C. and 954° C. for 100 hours, followed by air cooling, to determine the oxidation weight gain from the weight change before and after the test. Table 6 shows the tensile test results at room temperature, Table 7 shows the creep test results, and Table 8 shows the oxidation test results.

TABLE 6

| No. | 0.2% Proof stress (MPa) | Tensile strength (MPa) | Elongation (%) | Reduction of area (%) | Note |
|---|---|---|---|---|---|
| 6 | 859 | 1186 | 26.9 | 40.1 | Invention alloy |
| 23 | 1083 | 1391 | 26.3 | 41.8 | Comparative alloy |

TABLE 7

| No. | Test temperature (° C.) | Tensile strength (MPa) | Rupture time (h) | Note |
|---|---|---|---|---|
| 6 | 816 | 276 | 56 | Invention alloy |
| 23 | 816 | 276 | 46.9 | Comparative alloy |

TABLE 8

| No. | Test temperature (° C.) | Holding time (h) | Oxidation weight gain ($mg/cm^2$) | Note |
|---|---|---|---|---|
| 6 | 800 | 100 | 0.038 | Invention alloy |
| 23 | 800 | 100 | 0.271 | Comparative alloy |
| 6 | 954 | 100 | 0.327 | Invention alloy |
| 23 | 954 | 100 | 1.950 | Comparative alloy |

Table 6 shows that the invention alloy No. 6 has excellent mechanical properties such as 0.2% proof stress of 775 MPa or more, tensile strength of 1125 MPa or more, 20% or more elongation, and 20% or more reduction of area. Although the invention alloy No. 6 has slightly lower proof stress and tensile strength at room temperature than the comparative alloy No. 23, these values are higher than the lower limit (758 MPa) of room temperature proof stress and the lower limit (1103 MPa) of tensile strength of the standard AMS 5707M of aircraft materials corresponding to the comparative alloy No. 23.

Table 7 shows that the creep rupture time under the conditions of 816° C. and 276 MPa is 30 hours or more for the invention alloy No. 6, which is longer than that of comparative alloy No. 23. The creep rupture time of 23 hours or more of the standard AMS 5707M for aircraft materials corresponding to the comparative alloy No. 23 is sufficiently satisfied. Table 8 shows that the invention alloy No. 6 has significantly small oxidation weight gain after holding for 100 hours at 800° C. and 954° C. in air compared with the comparative alloy No. 23, and it has very good oxidation resistance. Thus, it can be seen that the invention alloy has good tensile properties at room temperature and high temperatures, creep strength at high temperatures, and oxidation resistance at high temperatures, even in a forged material.

INDUSTRIAL APPLICABILITY

As described above, when the invention alloy is applied to a forged product such as a gas turbine component, good hot workability and high strength can be achieved. In addition, when the invention alloy is used for a metal gasket, a spring for high temperature, a heat-resistant bolt, a seal ring, etc., which are used for joining parts exposed to high temperatures such as an exhaust system of an automobile engine, these have higher reliability because good hot workability to a material to be worked, good cold workability for the shape of parts, high strength during use at high temperatures, good thermal settling resistance, and the like can be achieved, and thermal settling during use can be prevented.

The invention claimed is:

1. A Ni-based alloy consisting of, by mass, C: 0.002 to 0.10%, Si: less than 1.0%, Mn: up to 1.0%, P: up to 0.04% (including 0%), S: up to 0.01% (including 0%), Cr: 15.0 to 25.0%, Co: 0.1 to 18.0%, Mo: not less than 2.0% and less than 4.0%, Al: 3.5 to 5.0%, Ti: not less than 0.01% and less than 0.5%, Zr: 0.01 to 0.1%, B: 0.001 to 0.015%, Fe: up to 3.0%, Mg or Mg+0.6×Ca: 0.0005 to 0.01%, N: up to 0.01% (including 0%), O: up to 0.005% (including 0%), and the balance of Ni with inevitable impurities, wherein S/Mg or S/(Mg+0.6×Ca) is up to 1.0, and wherein a G value represented by the following formula (1) is 30 to 45.

$$G=7+0.11Cr+8.23Al+4.66Ti-0.13(Ni+Co) \quad (1)$$

2. The Ni-based alloy according to claim 1, wherein the Ni-based alloy consists of, by mass, C: 0.005 to 0.05%, Si: up to 0.5%, Mn: up to 0.5%, P: up to 0.03% (including 0%), S: up to 0.007% (including 0%), Cr: 16.0 to 23.0%, Co: not less than 4.0% and less than 15.0%, Mo: not less than 3.0% and less than 4.0%, Al: 3.5 to 5.0%, Ti: 0.05% to 0.3%, Zr: 0.02 to 0.08%, B: 0.002 to 0.010%, Fe: up to 3.0%, Mg or Mg+0.6×Ca: 0.0005 to 0.01%, N: up to 0.01% (including 0%), O: up to 0.005% (including 0%), and the balance of Ni with inevitable impurities, and wherein S/Mg or S/(Mg+0.6×Ca) is up to 1.0.

3. The Ni-based alloy according to claim 1, wherein a solvus temperature of a γ' phase is 900 to 1000° C.

4. A heat-resistant plate material made of the Ni-based alloy according to claim 1.

5. The Ni-based alloy according to claim 1, wherein an upper limit of the Ti content is 0.3% by mass.

* * * * *